US008590248B2

(12) United States Patent
Lehane, Jr. et al.

(10) Patent No.: US 8,590,248 B2
(45) Date of Patent: Nov. 26, 2013

(54) INDEXING TAB FOR GRID RUNNERS

(75) Inventors: James J. Lehane, Jr., McHenry, IL (US); Donald J. Leahy, North Olmsted, OH (US); Steven E. Farley, Wellington, OH (US); Thomas G. Rowland, North Olmsted, OH (US); Peder J. Gulbrandsen, Aurora, IL (US)

(73) Assignee: USG Interiors, LLC, Chicago, IL (US)

( * ) Notice: Subject to any disclaimer, the term of this patent is extended or adjusted under 35 U.S.C. 154(b) by 7 days.

(21) Appl. No.: 13/451,654

(22) Filed: Apr. 20, 2012

(65) Prior Publication Data

US 2013/0276395 A1 Oct. 24, 2013

(51) Int. Cl.

| | |
|---|---|
| ***E04B 2/00*** | (2006.01) |
| ***E04B 5/00*** | (2006.01) |
| ***E04B 9/00*** | (2006.01) |

(52) U.S. Cl.

USPC ..... 52/506.09; 52/506.1; 52/506.07; 52/636

(58) Field of Classification Search

USPC ..... 52/506.06, 506.07, 506.08, 506.09, 52/506.01, 636, 795.1

See application file for complete search history.

(56) References Cited

U.S. PATENT DOCUMENTS

| | | | | |
|---|---|---|---|---|
| 3,320,713 | A | 5/1967 | Downing, Jr. | |
| 4,128,978 | A * | 12/1978 | Beynon | 52/232 |
| 4,679,375 | A | 7/1987 | Shirey | |
| 4,794,745 | A * | 1/1989 | Platt et al. | 52/506.07 |
| 4,848,054 | A * | 7/1989 | Blitzer et al. | 52/506.07 |
| 6,047,511 | A * | 4/2000 | Lehane et al. | 52/506.07 |
| 6,446,407 | B1 * | 9/2002 | Lehane et al. | 52/506.07 |
| 6,722,918 | B2 * | 4/2004 | McCoy | 439/533 |
| 8,146,316 | B2 * | 4/2012 | Boss et al. | 52/506.07 |
| 8,314,336 | B2 * | 11/2012 | Liang et al. | 174/68.1 |

* cited by examiner

*Primary Examiner* — Chi Q Nguyen

(74) *Attorney, Agent, or Firm* — Pearne & Gordon LLP

(57) ABSTRACT

A roll formed sheet metal grid runner, and method of its manufacture, for a suspended ceiling grid having indexing tabs stamped from a central web of the runner profile, the tabs being effective to reliably locate ceiling panels and, when the grid runner is nested with other identical runners in a package, avoid marring of visible surfaces.

1 Claim, 3 Drawing Sheets

INDEXING TAB FOR GRID RUNNERS

BACKGROUND OF THE INVENTION

The invention relates to suspended ceilings and, in particular, to improvements in grid runners.

PRIOR ART

Suspended ceiling grid runners are manufactured in a variety of cross sections to serve different functions and/or afford different appearances. Packaging of these grid runners for distribution may involve nesting them side-by-side with alternate runners being inverted. Such arrangements can minimize the size of a box in which the runners are packaged and the space taken up during transport and storage of the runners. While space may be conserved with a nested group of runners, the geometry of the runner cross section may allow the runner elements, visible in a finished installation, to be marred. Vibration during shipping and/or handling can cause parts of adjacent runners to mar the visible areas of a runner.

U.S. Pat. No. 4,679,375 shows a grid tee formed with tabs stamped out of a web. The tabs are intended to center tiles or panels in the grid spaces. The tabs reduce the risk that a panel can shift in the suspended grid space and slip off a flange. These prior art tabs, however, may be ineffective to restrain and center relatively thin panels of sheet metal or plastic.

SUMMARY OF THE INVENTION

The invention relates to a grid runner with an improved indexing tab construction. The inventive indexing tabs stamped from a central web of the grid runners, can protect nested grid runners from damage in transit. Once the grid runners are installed, the tabs, additionally, can restrain and center even relatively thin ceiling tiles in the grid spaces.

The indexing tab is especially adapted to be incorporated into a double reveal type grid runner. This runner type has a stepped flange which can be especially susceptible to marring when it is compactly nested in a package or box.

The indexing tab can be more readily implemented in certain types of grid runner constructions where the grid profile is made in two separate roll forming operations and when stamping is performed between these roll forming operations. In such runner constructions, the sheet metal area adjacent the lower margins of the web may not be folded in a preform state so that there is clearance for tooling to conventionally stamp the tabs at a level of the eventual flange. Locating the tabs at the flange level ensures that even thin panels can be restrained in the center of a grid space.

DESCRIPTION OF THE PREFERRED EMBODIMENT

Figure 5:
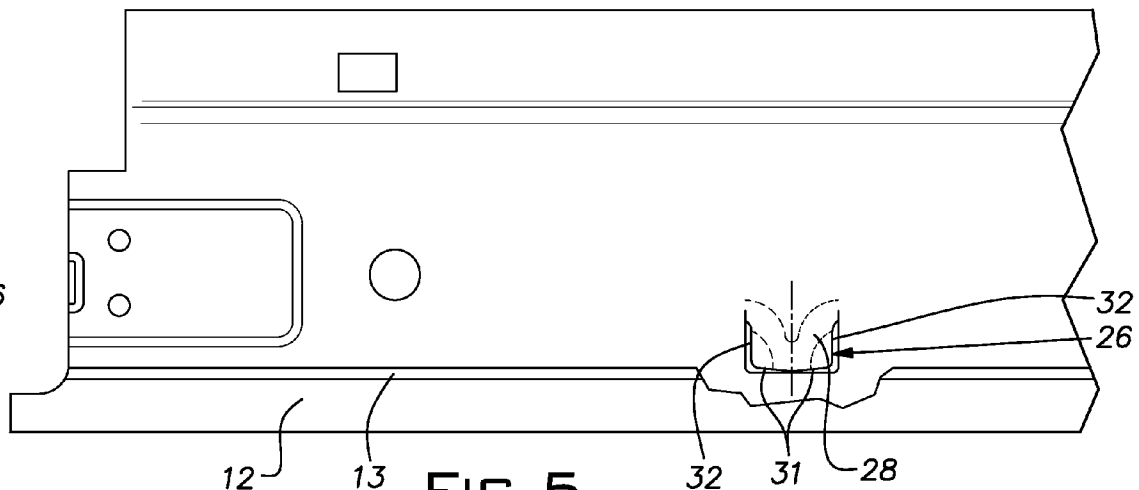
FIG. 5 is a fragmentary side elevational view of the grid runner of FIG. 4.
Figure 4:
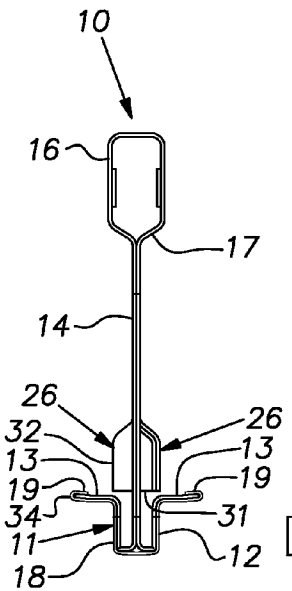
FIG. 4 is a cross-sectional view of a finish rolled grid runner made in accordance with the invention.

FIGS. 4 and 5 illustrate an elongated grid runner 10 used to form a grid for a suspended ceiling. The illustrated grid runner 10 is of a style sometimes referred to as a double reveal profile. The profile is characterized with a two-level flange 11. A central portion 12 of the flange 11 is dropped below laterally outward portions 13 of the flange. The grid runner also includes a central vertically extending web 14 above the flange 11 and a hollow reinforcing bulb 16 at the top of the web. In the illustrated case, the grid runner 10 is made of two roll formed sheet metal, typically steel, strips. A main body strip 17 forms an upper part of the flange 11, the double walls of the web 14 and the reinforcing bulb 16. A face sheet 18, typically of lighter gauge than the main body strip 17, forms the appearance or face side of the flange 11. The face strip is retained on the main body strip by marginal longitudinally extending areas 19 folded over longitudinal edges of the main body strip 17 in the manner of a hem. The outer side of the face strip 18 can be pre-painted as is customary.

The grid runner 10, as is conventional, can be provided as main runners and cross runners to form a rectangular grid that is suspended by wires. The flanges 11 serve to support ceiling tiles or panels in the grid spaces made by parallel and intersecting grid runners. The panels or tiles are typically carried on the upper sides of the laterally outward portions 13 of the flanges 11.

In the illustrated case, the central flange portion 12 is somewhat narrower than the reinforcing bulb 16. The illustrated grid runner 10 can be roll formed in two stages through a primary roll set and a secondary roll set.

Figures 1, 2:
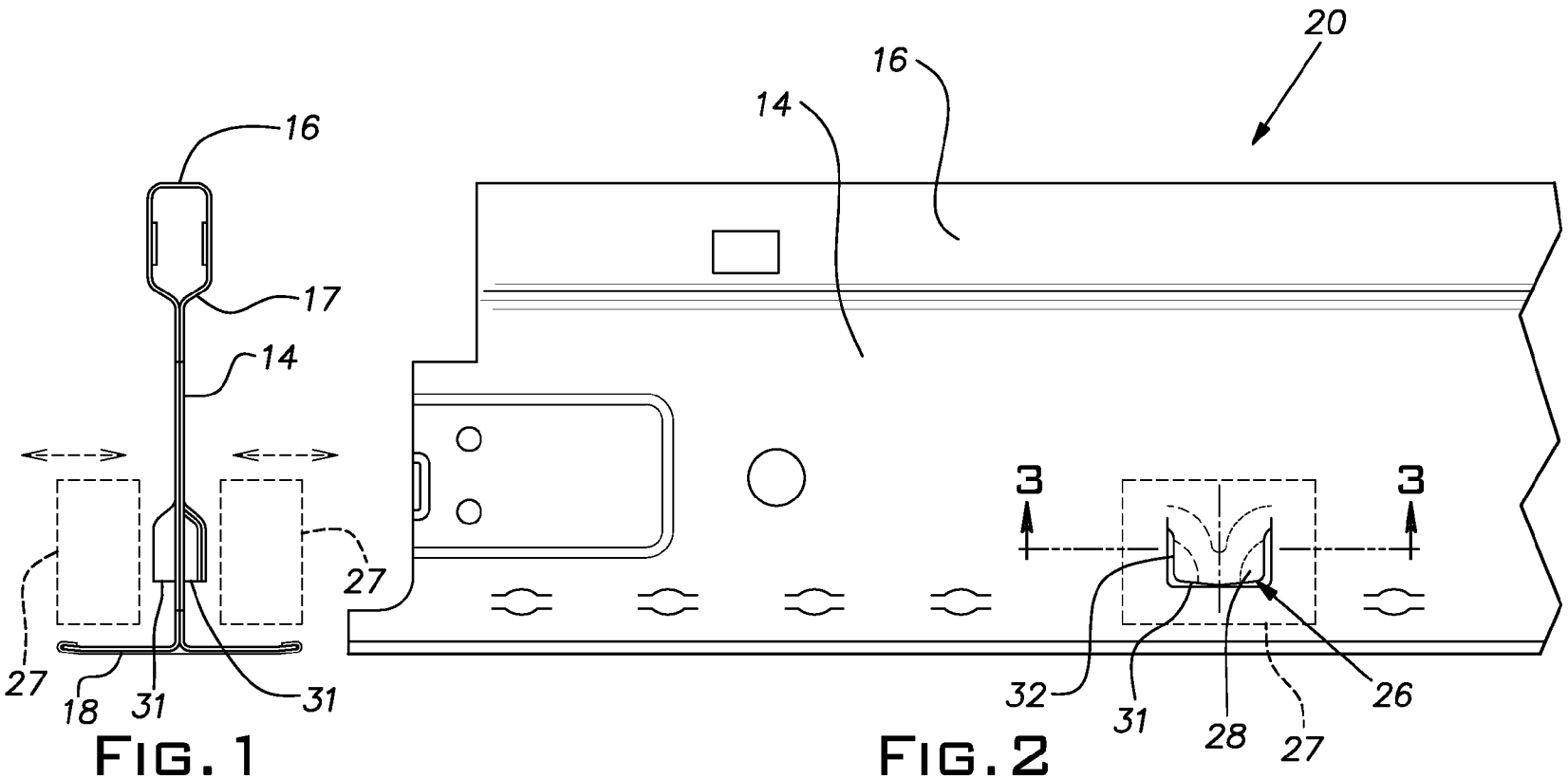
FIG. 1 is a cross-sectional view of a grid runner preform prior to final roll forming.
FIG. 2 is a fragmentary side elevational view of the grid runner preform of FIG. 1.
Figure 3:
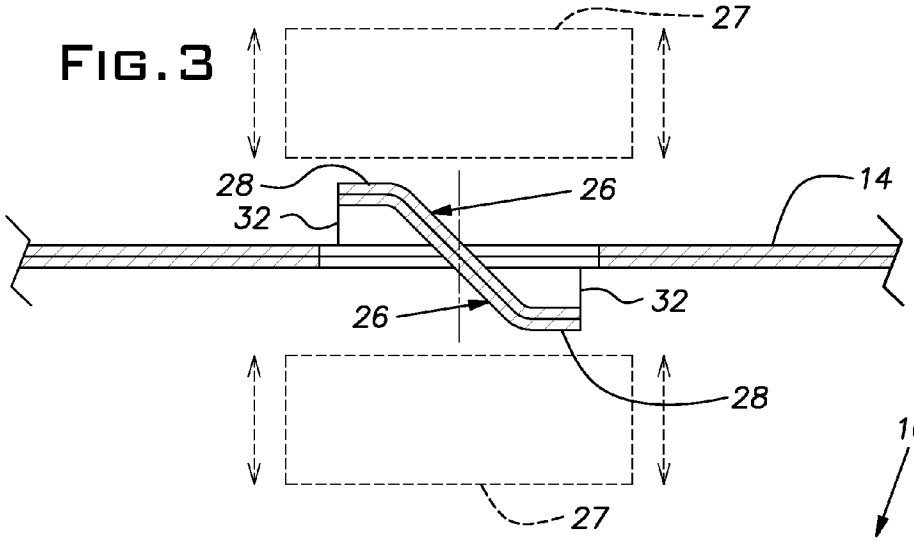
FIG. 3 is a sectional view of the grid runner preform taken in the plane of the lines 3-3 in FIG. 2.

When the strips 17, 18 exit the first roll set, they make up a grid runner preform 20 shown in FIGS. 1 and 2. The preform 20 has a generally conventional grid tee shape although the web 14 has a greater height than is normal. In the preform state, the material ultimately forming the two level flange 11 extends in a flat plane, apart from the marginal hem areas 19, perpendicular to the web 14. The grid runner preform 20 is received in a press where various details, including cross tee slots and end connectors are formed or, in the illustrated case, end connector pockets are formed for receiving end connectors. In this intermediate press station, indexing tabs 26 are stamped out of the web 14 by combination punch and die sets diagrammatically illustrated at 27. The indexing tabs 26 are formed on both sides of the web 14. Each tab 26 has a generally flat face 28 parallel to the web 14 and a free edge having sections 31, 32 generally lying in planes perpendicular to the web and to each other. The punch and die sets 27 on opposite sides of the preform 20 are complimentary to each such that the punch of one unit works with the die of the other and vice versa to form a pair of adjacent tabs during a stroke of the press. Alternatively, a simple die punch set can be used to form a single tab at a particular location along the length of the preform 20. The material remaining at the web 14 where the cut edges 31, 32 are severed from the web proper are ordinarily supported by a die surface on the side of the web to which a tab is displaced. The spacing of the tab faces 28 from the web 14 or center of the finished grid runner 10 is selected to position a ceiling panel or tile in the center of a grid space. The tabs 26 whether in pairs on opposite sides of the web 14 or standing alone are made adjacent each end of the grid runner 10. Additionally, main runners and long cross runners are formed with additional tabs on each side of the web along their lengths.

Figure 7:
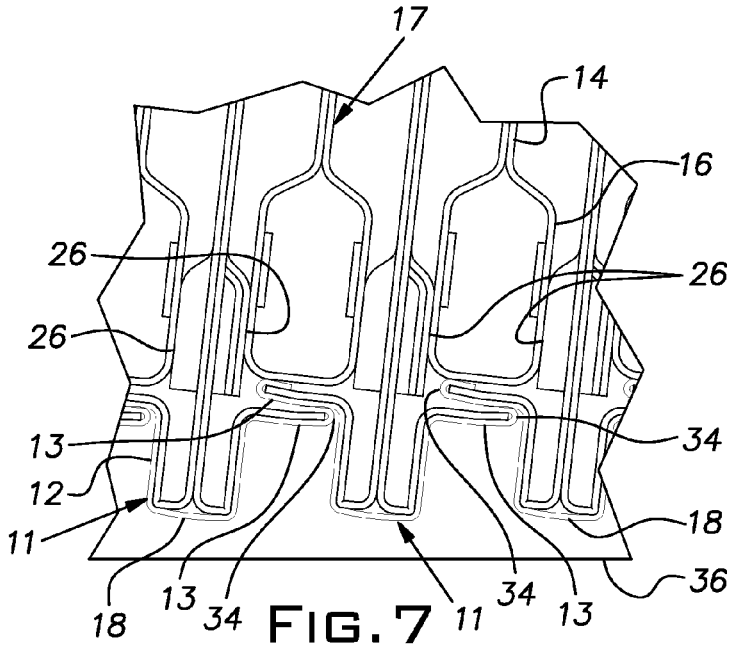
FIG. 7 is an enlarged fragmentary view of the package shown in FIG. 6.

After the grid runner preform has been stamped with the tabs 26 and other features, it is passed through a secondary roll set. In this subsequent roll forming step, the flange 11 is finally shaped to the stepped configuration illustrated in FIG. 4. FIGS. 4 and 7 illustrate that the tabs 26 extend vertically upwardly from the level of the outer flange portions 13. More precisely, the lower edge 31 of a tab 26 is preferably less than about 0.010 in. above the upper surface of a hem 19 and can be at or below this surface. With this geometry, the tabs 26 can center ceiling panels of relatively thin gauge, e.g. 0.020 in. thick, without the risk that the panels can slip under the tabs and not be centered.

Figure 6:
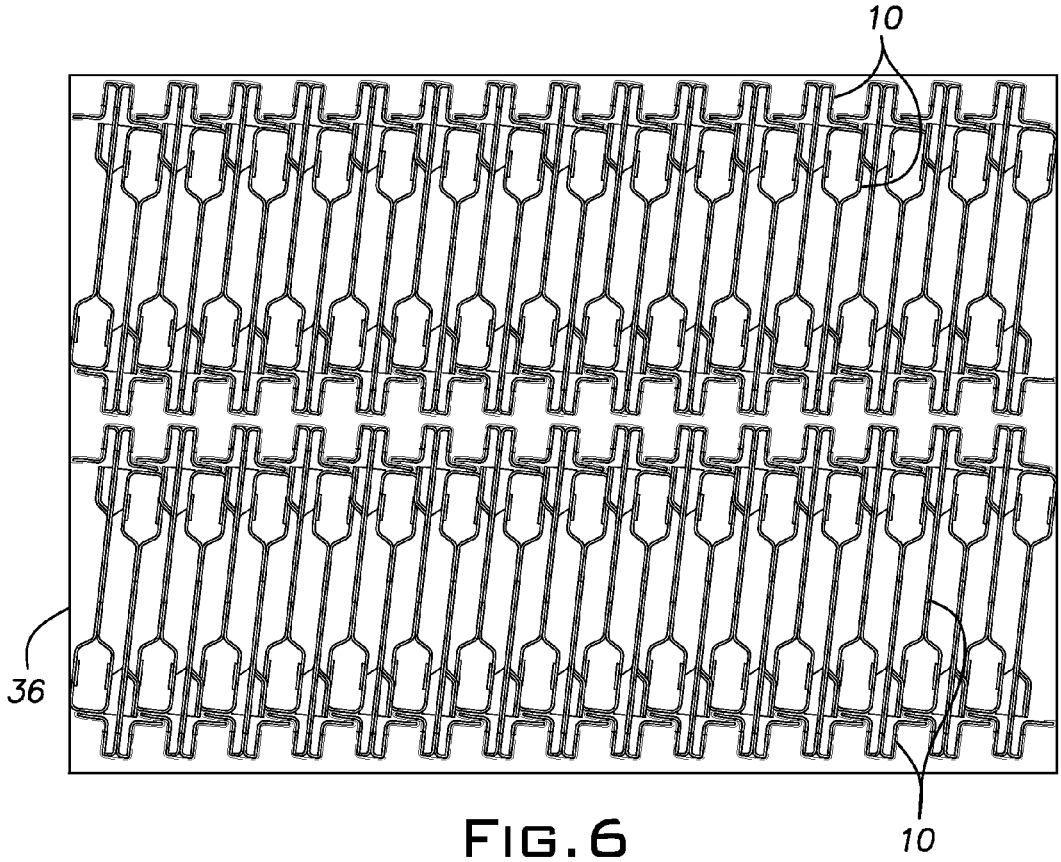
FIG. 6 is a diagrammatic end view of a package of grid runners in accordance with the invention.

It is customary to nest grid runners side-by-side or laterally to minimize the size of a quantity of grid runners in a package for shipping and storage purposes. FIGS. 6 and 7 illustrate a packaging arrangement for a number of grid runners 10 received in a box 36, typically a cardboard container. It will be seen that alternate grid runners 10 are arranged with their adjacent upper flange portions 13 overlapped. Intervening grid runners 10 are inverted and their adjacent upper flange portions 13 are similarly overlapped. The tabs 26 of each grid runner abut the reinforcing bulbs 16 of adjacent grid runners. The tabs 26 are advantageously proportioned so that their width or lateral offset, measured from the center of the web 14, combined with the width of a reinforcing bulb 16 is greater than the width of a flange 11 across its distal edges plus the width of the dropped central or mid-portion 12 of the flange. The foregoing described tab geometry prevents the distal flange edges, designated 34 of either alternate or intervening grid runners from contact with the dropped central flange portions 12 of adjacent runners. This situation is illustrated in FIG. 7. Contact of these elements during package handling and shipping could result in abrasion and marring of the visible surfaces of the drop central flange portion 12.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A plurality of identical roll formed elongated sheet metal grid runners for a suspended ceiling, each grid runner having an upper hollow reinforcing bulb, a central web extending below the bulb, and a lower stepped flange supported from the web, the stepped flange having a central U-shaped portion and laterally outward portions at upper areas of the central portion, the laterally outward portions having longitudinally extending distal edges, and locating tabs stamped out of both sides of the web at locations spaced along a length of the grid runner, a sum of a width across adjacent tabs on opposite sides of the web and a width of the bulb being greater than a sum of a distance of a distal edge of a flange from a center of the runner and a half of a width of the flange central portion, whereby the tabs are effective to space the distal flange edges from the central flange portions of alternate grid runners when the grid runners are nested laterally in a package with the identical grid runners in a pattern in which intervening grid runners are inverted and the reinforcing bulbs of the intervening runners are disposed between the tabs of alternate grid runners.

* * * * *